United States Patent [19]

Adachi et al.

[11] Patent Number: 5,003,610

[45] Date of Patent: Mar. 26, 1991

[54] WHOLE SURFACE DRIVEN SPEAKER

[75] Inventors: Atsushi Adachi; Mutsuo Musha, both of Akishima, Japan

[73] Assignee: Fostex Corporation, Japan

[21] Appl. No.: 250,223

[22] Filed: Sep. 28, 1988

[30] Foreign Application Priority Data

Apr. 14, 1988 [JP] Japan ..... 63-50449[U]
Apr. 14, 1988 [JP] Japan ..... 63-50450[U]
Apr. 15, 1988 [JP] Japan ..... 63-50498[U]

[51] Int. Cl.[5] ..... H04R 9/00

[52] U.S. Cl. ..... 381/203; 381/196; 381/199

[58] Field of Search ..... 381/199, 201, 202, 203, 381/153, 158, 186, 192, 193, 194, 196; 181/157, 167, 170

[56] References Cited

U.S. PATENT DOCUMENTS 1,403,849 1/1922 Delany ..... 181/170
3,922,504 11/1975 Kishikawa et al. ..... 179/115.5
3,997,739 12/1976 Kishikawa ..... 381/201
4,471,173 9/1984 Winey ..... 381/203
4,544,806 10/1985 Nieuwendijk ..... 381/158
4,699,242 10/1987 Ono ..... 181/167
4,803,733 2/1989 Carver ..... 381/199

FOREIGN PATENT DOCUMENTS 0030497 2/1982 Japan ..... 181/167
0062696 4/1982 Japan ..... 381/202
01154996 9/1983 Japan ..... 181/167

*Primary Examiner*—Jin F. Ng
*Assistant Examiner*—M. Nelson McGeary, III
*Attorney, Agent, or Firm*—Leydig, Voit & Mayer

[57] ABSTRACT

A whole surface driven speaker includes a diaphragm of an insulating plastic sheet carrying a conductor coil pattern. A foamed mica plate is bonded to the diaphragm. Two groups of permanent magnets are arranged on both sides of the diaphragm and oppose each other with pole faces of the same polarity across the diaphragm but with poles faces of opposite polarity adjoining each other on each side of the diaphragm.

1 Claim, 2 Drawing Sheets

WHOLE SURFACE DRIVEN SPEAKER

BACKGROUND OF THE INVENTION

This invention relates to whole surface driven speakers in which a diaphragm carrying a strip-shaped coil is disposed between two groups of permanent magnets having opposing magnetic pole surfaces.

The whole surface driven speakers of the kind referred to can be effectively employed in acoustic equipment of a relatively wide frequency band.

Various types of whole surface driven speakers have been suggested, an example of which is the one disclosed in U.S. Pat. No. 3,922,504 to Kenichiro Kishikawa et al. According to this U.S. patent, an electro-acoustic transducer comprises a diaphragm formed by providing a series of strip shaped conductor coils on a sheet of insulating material. Two groups of elongated permanent magnets are arranged on both sides of the diaphragm so as to oppose each other. Pole faces of the same polarity pole oppose each other across the diaphragm but pole faces of opposite polarity are adjacent to each other. Each group of permanent magnets is respectively secured to a different support plate having sound-passing perforations, and a support member secured to peripheral edges of the diaphragm to support it in tension is held between the peripheral portions of the support plates. In operation, an electric current signal at acoustic frequencies is made to flow through the coil on the diaphragm. As the coil is disposed in a magnetic field flowing along the plane of the diaphragm between adjacent permanent magnets, the signal causes the diaphragm to be subjected to an electromagnetic force in a direction perpendicular to the plane of the diaphragm to vibrate the diaphragm in response to the magnitude of the signal. The resulting audible sound wave passes through the perforations of the support plates.

In the electro-acoustic transducer according to the above-described U.S. patent, on the other hand, the support member for the diaphragm is to provide thereto with a surface rigidity by means of the tension but it is difficult to render the tension to be uniform over the entire diaphragm, the difficulty being increased as the vibratory area of the diaphragm expands. Accordingly, there have been involved such problems that the surface rigidity and tension of the diaphragm become likely to fluctuate and insufficient, resulting in the generation of abnormal sounds and unstable or unbalanced frequency characteristics, and the transducer is no more suitable for use in the acoustic apparatus and equipments.

SUMMARY OF THE INVENTION

Accordingly, it is a primary object of the present invention to provide a whole surface driven speaker having a high rigidity while a proper internal loss, and which can prevent abnormal sound from being generated.

Another object of the present invention is to provide a whole surface driven speaker which has substantially stable frequency characteristics in a relatively wide frequency band.

Still another object of the present invention is to provide a whole surface driven speaker which makes an excellent woofer for low-frequency sounds on account of having a high volumetric effect in the low-frequency range of sound due to the internal loss being properly maintained, and on account of the frequency characteristics being stabilized.

A whole surface driven speaker according to the present invention comprises a diaphragm made from a sheet of insulating material having a coil provided thereon and an edge member provided along peripheral edges of the sheet. A foamed mica plate is bonded to a surface of the diaphragm. Two groups of magnet members are disposed on opposite sides of the diaphragm and spaced therefrom and opposing one another. Pole faces of the same polarity oppose one another through the diaphragm but with poles of opposite polarity adjoining one another on each side of the diaphragm. A pair of support plates support each group of the magnet members and having a plurality of sound-passing perforations. A supporter secured to the edge member supports the peripheral edges of the diaphragm and is held between peripheral parts of the support plates.

Other objects and advantages of the present invention will become clear from the following explanation of the invention with reference to preferred embodiments of the invention shown in the accompanying drawings.

While the present invention shall now be explained with reference to the preferred embodiments shown in the accompanying drawings, it should be appreciated that the intention is not to limit the invention only to these embodiments but to include all alterations, modifications and equivalent arrangements possible within the scope of the appended claims.

DESCRIPTION OF THE PREFERRED EMBODIMENTS

Figure 1:
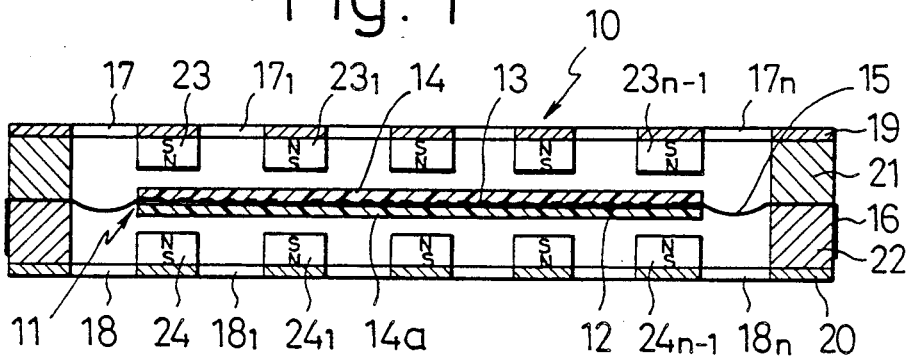
FIG. 1 is a cross-sectional view of an embodiment of a whole surface driven speaker according to the present invention.
Figure 2:
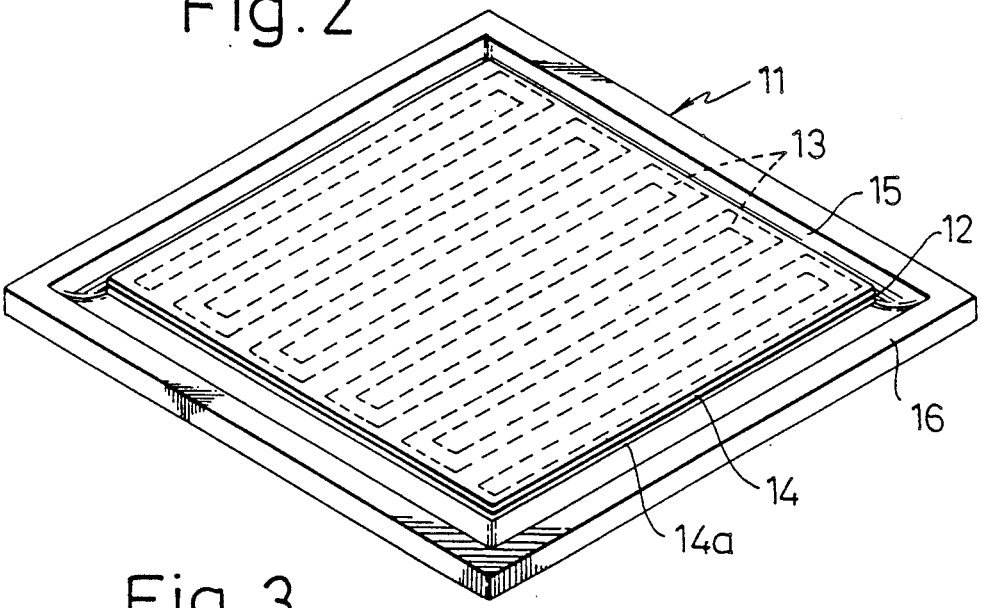
FIG. 2 is a perspective view of a diaphragm employed in the speaker of FIG. 1.

Referring here to FIGS. 1 and 2, a first embodiment of a whole surface driven speaker 10 according to the present invention comprises a diaphragm 11 which is formed from a sheet of an insulating material, preferably a plastic film 12, and an electrically conducting coil 13 provided on a surface of the film 12 in a continuous back and forth pattern. The coil is in the form of a strip and is formed on the film 12 by means of gluing, printing, etching or the like. In the present embodiment, foamed mica plates 14 are **14*a* of the same size as the film 12 and glued to both sides of the diaphragm 11 so that the diaphragm 11 maintains proper insertion loss, while the rigidity, that is, the mechanical strength of the diaphragm 11 is thereby elevated. In this case, the foamed mica plates 14 and 14*a* are preferably sheets of foamed mica having a specific gravity of about 0.05~0.3, more desirably about 0.1 optimal section of the foamed mica prevents the output sound pressure level of the diaphragm from falling even when the foamed mica plates 14 and 14***a* are provided on both sides of the diaphragm 11 to give it adequate rigidity.

An edge member 15 is secured to the peripheral edges of the diaphragm about its entire periphery. This edge member 15 is preferably formed of a material of small compliance such as a foamed plastic, cloth or the like. The film 12 and edge member 15 may be bonded to each other by a suitable plastic binder. When a foamed plastic material is employed for the edge member 15, the film 12 and the edge member 15 may be integral with one another. Further, formed on the periphery of the edge member 15.

On both sides of the diaphragm 11, a pair of support plates 19 and 20 respectively having the same number of sound-passing perforations 17, $\mathbf{17}_1$, . . . $\mathbf{17}_n$ and 18, $\mathbf{18}_1$, . . . $\mathbf{18}_n$ are disposed and slightly separated from the diaphragm 11 in parallel with one another. More concretely, these support plates 19 and 20 are connected by two halves 21 and 22 of a rectangular frame-shaped supporter. The supporter halves 21 and 22 hold between them the edge member 15 of the diaphragm 11 and contact the inside walls of the securing member 16, while the plates 19 and 20 are secured to the supporter halves 21 and 22 and maintained parallel to one another and spaced from the diaphragm 11. Two groups of permanent magnets 23, $\mathbf{23}_1$, . . . $\mathbf{23}_{n-1}$ and 24, $\mathbf{24}_1$, . . . $\mathbf{24}_{n-1}$ are secured to the mutually opposing surfaces of the support plates 19 and 20, i.e., to the inner surfaces facing the diaphragm. As shown in FIGS. 1 and 2, the sound-passing perforations 17, $\mathbf{17}_1$, . . . $\mathbf{17}_n$ of support plate 19 or perforations 18, $\mathbf{18}_1$, . . . $\mathbf{18}_n$ of support plate 20 extend in the same direction as the elongated parts of the coil 13 and are mutually parallel. Permanent magnets 23, $\mathbf{23}_1$, . . . $\mathbf{23}_{n-1}$ or 24, $\mathbf{24}_1$, . . . $\mathbf{24}_{n-1}$ are of an elongated bar-shape and are secured to plate 19 or 20 respectively, between adjacent perforations 17, $\mathbf{17}_1$, . . . $\mathbf{17}_n$ or 18, $\mathbf{18}_1$, . . . $\mathbf{18}_n$ and extend in the same direction as the elongated parts of the coil 13 and are mutually parallel FIG. 1 shows only six sound-passing perforations and five permanent magnets for each group.

These two groups of permanent magnets 23, $\mathbf{23}_1$, . . . $\mathbf{23}_{n-1}$ and 24, $\mathbf{24}_1$, . . . $\mathbf{24}_{n-1}$ are so arranged that the pole surfaces which oppose one another across the diaphragm 11 are of the same polarity, while adjacent pole surfaces on the same side of the diaphragm are of opposite polarity. That is, when a first opposing pair of magnets 23 and 24 have their N pole surfaces opposing one another, then the next opposing pair of magnets $\mathbf{23}_1$ and $\mathbf{24}_1$ have with their S pole surfaces opposing one another.

In the present embodiment, an acoustic electric current signal is provided from, for example, an unillustrated pre-amplifier to the coil 13 on the diaphragm 11 and flows therethrough. The coil 13, which is already influenced by the magnetic force of the opposing permanent magnets 23, $\mathbf{23}_1$, . . . $\mathbf{23}_{n-1}$ and 24, $\mathbf{24}_1$, . . . $\mathbf{24}_{n-1}$, is caused to vibrate together with the film 12 of the diaphragm 11 at a frequency corresponding to the magnitude of the acoustic electric current signal. A corresponding audible sound wave passes through the perforations 17, $\mathbf{17}_l$, . . . $\mathbf{17}_n$ and 18, $\mathbf{18}_1$, . . . $\mathbf{18}_{n-1}$ in the support plates 19 and 20.

Figure 3:
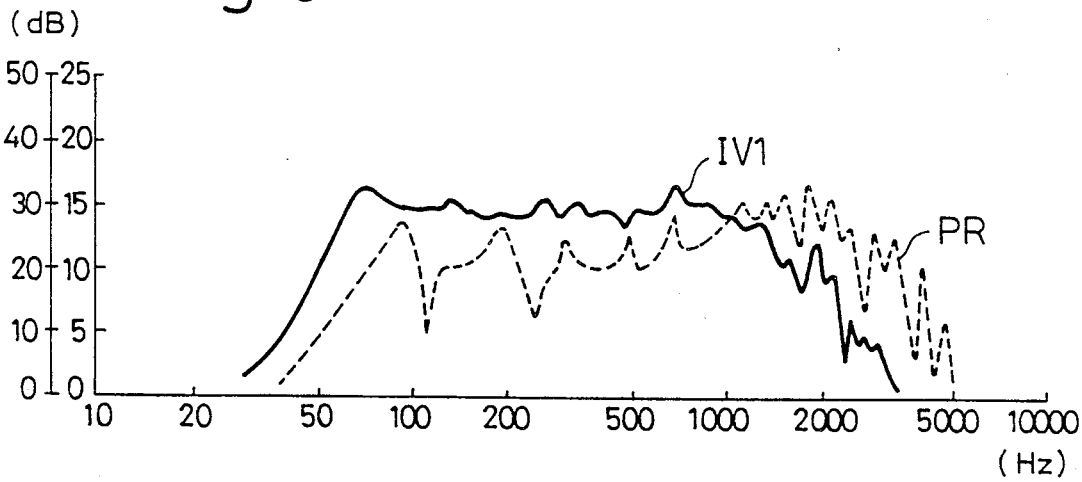
FIG. 3 is a diagram showing output sound pressure-to-frequency characteristics of the speaker of FIG. 1 and of a conventional speaker.

The output sound pressure-to-frequency characteristics of the whole surface driven speaker of FIGS. 1 and 2 are illustrated in FIG. 3. The solid line IV1 represents the characteristics of the embodiment of FIG. 1, while the dashed line PR represents the characteristics for a conventional speaker without a foamed mica plate. It is clear that a speaker of the present invention has much flatter and more elevated frequency characteristics than the conventional speaker. The illustrated characteristics for the present invention are flat particularly in the low-frequency range of 60 to 1,000 Hz. Abnormal sound generation can be reduced to a large extent by means of the elevated rigidity of the diaphragm 11 with the provision of the foamed mica plates 14 and 14*a*, relatively stationary frequency characteristics can be attained, and a speaker which is excellent in the low-frequency sound range can be obtained.

Figure 4:
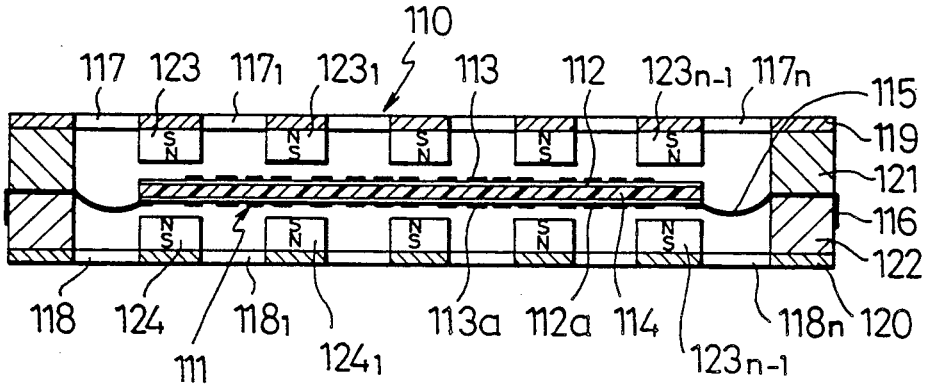
FIG. 4 is a cross-sectional view of another embodiment of the whole surface driven speaker of the present invention.
Figure 5:
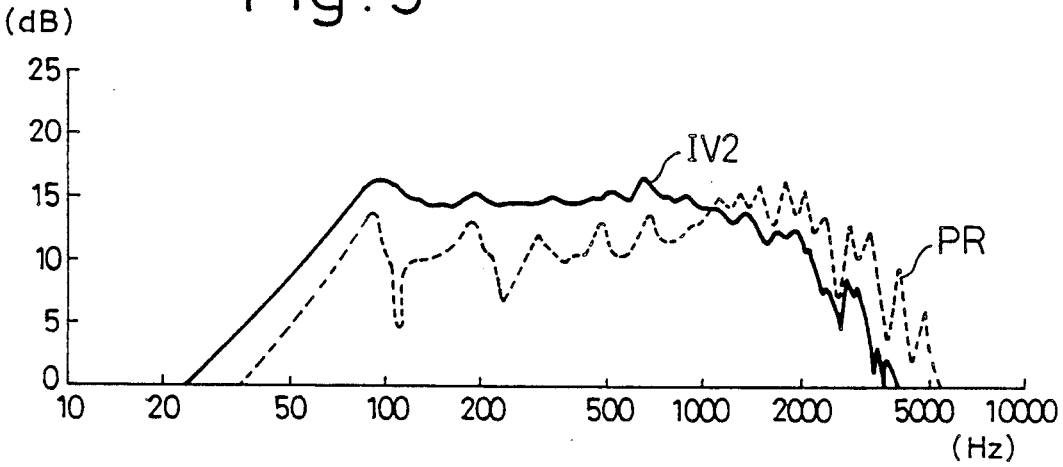
FIG. 5 is a diagram showing the output sound pressure-to-frequency characteristics of the speaker of FIG. 4 and of a conventional speaker.

FIG. 4 illustrates another embodiment of the present invention. Elements of FIG. 4 bear the same reference numeral plus 100 as the corresponding elements of the embodiment of FIGS. 1 and 2. In this embodiment of a whole surface driven speaker 110 a diaphragm 111 comprises two insulating sheets 112 and 112*a* laminated and bonded to both surfaces of a single foamed mica plate 114. A pair of coils 113 and 113*a* are disposed on the outer surface of the insulating sheets 112 and 112*a*, respectively, in the same back and forth pattern and in mirror symmetry with one another. The frequency characteristics of this speaker are shown by the solid line IV2 in FIG. 5, while the dotted line PR shows the characteristics of a conventional speaker. It can be seen that the speaker of FIG. 4 has remarkably flat frequency. In particular, the speaker of this embodiment has excellent frequency characteristics in a low frequency range of 100 to 1,000 Hz.

The structure and operation of the speaker of FIG. 4 are otherwise substantially the same as for the embodiment of FIGS. 1 and 2.

Figure 6:
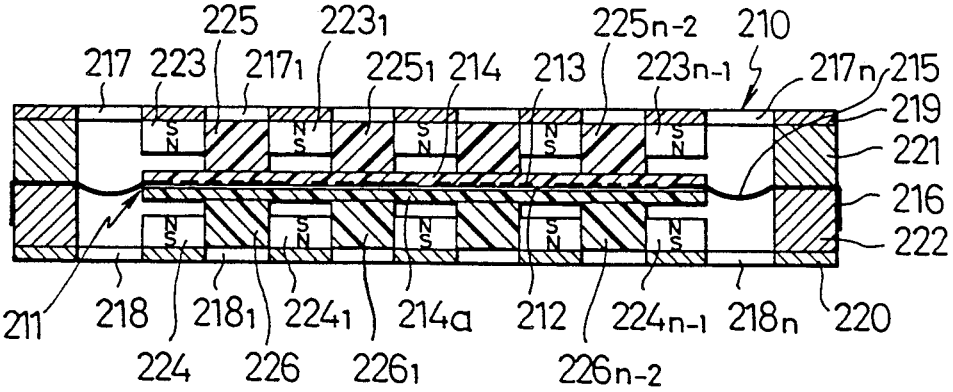
FIG. 6 is a cross-sectional view of yet another embodiment of the whole surface driven speaker according to the present invention.

FIG. 6 shows yet another embodiment of the present invention. The elements of FIG. 6 bear the same reference numeral plus 200 as the corresponding elements of the embodiment of FIGS. 1 and 2. In this embodiment, damping members 225, . . . $\mathbf{225}_{n=2}$ or 226, . . . $\mathbf{226}_{n-2}$ are provided which engage the foamed mica plate 214 or 214*a* and respective edges of sound-passing perforations $\mathbf{217}_1$, . . . $\mathbf{217}_{n-1}$ or $\mathbf{218}_1$, . . . $\mathbf{218}_{n-1}$ of a support plate 219 or 219*a*. These dumping members 225, . . . $\mathbf{225}_{n-2}$ and 226, . . . $\mathbf{226}_{n-2}$ are preferably made of a soft expanded macromolecular material, i.e., urethane foam. By properly varying the foaming rate of the urethane foam, the acoustic impedance can be varied, and high-frequency range characteristics of audible sound wave transmitted through the damping members 225, . . . $\mathbf{225}_{n-2}$ and 226, . . . $\mathbf{226}_{n-2}$ as well as the perforations $\mathbf{217}_1$, . . . $\mathbf{217}_{n-1}$ and 218, . . . $\mathbf{218}_{n-1}$ can be adjusted.

The structure and operation of the speaker of FIG. 6 are otherwise substantially the same as for the embodiment of FIGS. 1 and 2.

Various design modifications can be made to a whole surface driven speaker according to the present invention. For example, in all of the above-described, the number of sound-passing perforations, permanent magnets and damping members can be changed.

What we claim as our invention is:

1. A whole surface driven speaker comprising:

a diaphragm comprising a sheet of an electrically insulating material;

a coil which is disposed on said diaphragm;

a first foamed mica plate which is bonded to a surface of said diaphragm;

a second foamed mica plate, said diaphragm and said coil being sandwiched between said first and second foamed mica plates;

two groups of magnets which oppose one another from opposite sides of said diaphragm and which are spaced from said diaphragm;

a pair of support plates disposed on opposite sides of said diaphragm which support said magnets and said diaphragm; and damping members which are disposed between said foamed mica plates and said support plates;

wherein said magnets have pole faces and said damping members are not disposed between said pole faces and said mica plates.

* * * * *